US006605166B2

(12) United States Patent
Koike et al.

(10) Patent No.: US 6,605,166 B2
(45) Date of Patent: Aug. 12, 2003

(54) METHOD FOR MANUFACTURING HIGH STRENGTH BOLT EXCELLENT IN RESISTANCE TO DELAYED FRACTURE AND TO RELAXATION

(75) Inventors: Seiichi Koike, Wako (JP); Mitsuo Takashima, Wako (JP); Katsuhiro Tsukiyama, Fujisawa (JP); Yuichi Namimura, Kobe (JP); Nobuhiko Ibaraki, Kobe (JP)

(73) Assignees: Kabushiki Kaisha Kobe Seiko Sho, Kobe (JP); Honda Motor Co., Ltd., Tokyo (JP); Saga Tekkohsho Co., Ltd., Saga (JP)

( * ) Notice: Subject to any disclaimer, the term of this patent is extended or adjusted under 35 U.S.C. 154(b) by 0 days.

(21) Appl. No.: 09/926,715

(22) PCT Filed: Apr. 5, 2001

(86) PCT No.: PCT/JP01/02971

§ 371 (c)(1),
(2), (4) Date: Dec. 6, 2001

(87) PCT Pub. No.: WO01/79567

PCT Pub. Date: Oct. 25, 2001

(65) Prior Publication Data

US 2002/0179207 A1 Dec. 5, 2002

(30) Foreign Application Priority Data

Apr. 7, 2000 (JP) ..... 2000-107006
Mar. 22, 2001 (JP) ..... 2001-083281

(51) Int. Cl.[7] ..... C21D 8/00

(52) U.S. Cl. ..... 148/587; 148/599; 148/649; 148/651

(58) Field of Search ..... 148/587, 649, 148/650, 651, 599

(56) References Cited

FOREIGN PATENT DOCUMENTS

| | | |
|---|---|---|
| JP | 2-290922 | 11/1990 |
| JP | 5-105957 | 4/1993 |
| JP | 8-3640 | 1/1996 |
| JP | 9-67622 | 3/1997 |
| JP | 11-315347 | 11/1999 |
| JP | 11-315348 | 11/1999 |
| JP | 11-315349 | 11/1999 |

*Primary Examiner*—Deborah Yee
(74) *Attorney, Agent, or Firm*—Oblon, Spivak, McClelland, Maier & Neustadt, P.C.

(57) ABSTRACT

A high-strength bolt having excellent delayed fracture resistance and stress relaxation resistance in addition to a tensile strength of 1200 N/mm$^2$ or higher is disclosed. A steel material for the high-strength bolt includes C: 0.50 to 1.0% by mass (hereinafter, referred to simply as "%"), Si: 0.5% or less (not including 0%), Mn: 0.2 to 1%, P: 0.03% or less (including 0%) and S: 0.03% or less (including 0%). The steel material has pro-eutectoid ferrite, pro-eutectoid cementite, bainite and martensite structures at less than 20% in total and a pearlite structure as the remainder. The high-strength bolt is produced by drawing the steel material severely to obtain a steel wire, forming the steel wire into a bolt shape through a cold heading, and subjecting the shaped steel wire to a blueing treatment at a temperature within a range of 100 to 400° C.

10 Claims, 3 Drawing Sheets

5 μm (×3000)

5 μm (×3000)

METHOD FOR MANUFACTURING HIGH STRENGTH BOLT EXCELLENT IN RESISTANCE TO DELAYED FRACTURE AND TO RELAXATION

TECHNICAL FIELD

This invention relates to a method for manufacturing a high-strength bolt mainly for an automobile. More particularly, the present invention relates to an useful method for manufacturing a high-strength bolt having excellent delayed fracture resistance and stress relaxation resistance in addition to a tensile strength (strength) of 1200 N/mm$^2$ or more.

BACKGROUND ART

As a steel for a general high-strength bolt, used has been medium carbon alloy steel (SCM435, SCM440, SCr440 etc.) having a required strength by quench hardening and tempering thereof. However, in case that an increased tensile strength of beyond 1200 N/mm$^2$ is applied to such a general high-strength bolt for automobiles and various industrial equipment, it is likely to cause a delayed fracture within the high-strength bolt. For this reason, the applicable condition of the high-strength bolt has been limited.

The delayed fracture is classified into two types, one generated in a non-corrosive environment and the other generated in a corrosive environment. It has been said that a variety of factors are intricately intertwined to cause the delayed fracture, and therefore it is difficult to identify the main factor. As the control factors to suppress the delayed fracture, known have been a tempering temperature, a steel microstructure, a steel hardness, a crystal grain size of the steel, contents of various ally elements and the like.

However, an effective method for suppressing the delayed fracture has not been established. Various methods have been proposed, but they are only in a process of trial and error.

Techniques for improving the delayed fracture resistance have been disclosed by Japanese Unexamined Patent Publication Nos. 60-114551, 2-267243, 3-243745 and the like. In these techniques, by adjusting contents of various main alloy elements, obtained can be a steel material for high-strength bolt having an excellent delayed fracture resistance regardless of its high tensile strength of 1400 N/mm$^2$ or more. These techniques, however, cannot completely get rid of the possibility of generating such a delayed fracture. Therefore, the high-strength bolt obtained from the above-mentioned steel material has an extremely limited applicability.

On the other hand, a fastening bolt for use at high temperatures (including the above-mentioned high-strength bolt) has another problem that its proof stress ratio decreases when the bolt is in use, resulting in a phenomenon of lowering a fastening strength thereof. This phenomenon is called a relaxation (stress relaxation). In particular, when a bainitic steel, a pearlitic steel or the like rather than a hardened and tempered steel is used for the bolt, the resultant bolt may have a poor resistance to such a phenomenon (i.e., poor stress relaxation resistance). This phenomenon possibly causes an elongation of the bolt, which prevents the bolt from keeping the initial fastening strength. Therefore, for example when the bolt is for a purpose associated with an automobile engine, the bolt needs to exhibit a satisfactorily high relaxation resistance property. However, conventionally, the relaxation resistance property of high-strength bolts has been left out of consideration.

An object of the present invention is to improve the above-mentioned problems, thereby to provide a useful method for manufacturing the high-strength bolt having an excellent delayed fracture resistance and stress relaxation resistance as well as a satisfactory-level tensile strength of 1200 N/mm$^2$ or more.

DISCLOSURE OF THE INVENTION

It is an object of the present invention to provide a method for producing a high-strength bolt having excellent delayed fracture resistance and stress relaxation resistance. The method includes steps of: preparing a steel material; drawing the steel material severely to obtain a steel wire; forming the steel wire into a bolt shape through a cold heading; and subjecting the shaped steel bolt to a blueing treatment at a temperature within a range of 100 to 400° C. The steel material includes C: 0.50 to 1.0% by mass (hereinafter, referred to simply as "%"), Si: 0.5% or less (not including 0%), Mn: 0.2 to 1%, P: 0.03% or less (including 0%) and S: 0.03% or less (including 0%). And it has pro-eutectoid ferrite, pro-eutectoid cementite, bainite and martensite structures. The total area rate of them is less than 20%. It also has a pearlite structure as the balance. By this method, produced can be a high-strength bolt having excellent delayed fracture resistance and stress relaxation resistance in addition to a tensile strength of 1200 N/mm$^2$ or higher.

The steel material used in the method, if necessary, further includes (a) Cr: 0.5% or less (not including 0%) and/or Co: 0.5% or less (not including 0%), (b) one or more selected from a group consisting of Mo, V and Nb, whose total content is 0.3% or less (not including 0%), and/or the like.

BEST MODE FOR CARRYING OUT THE INVENTION

Figure 1A:
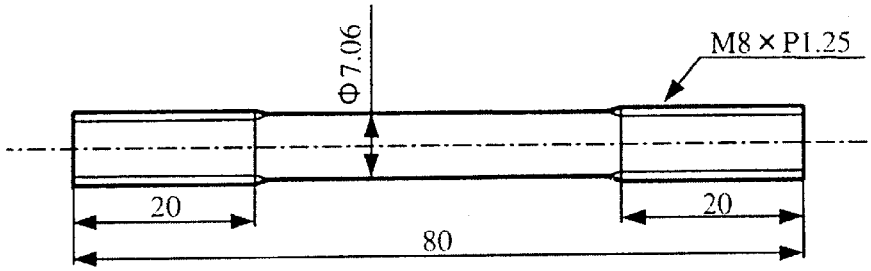
FIG. 1 schematically shows a configuration of a bolt to be subjected to a delayed fracture test in examples.

The inventors had studied about the cause of a poor delayed fracture resistance of the conventional high-strength bolt. As a result, it was found that there is a limit in the conventional methods for improving the delayed fracture resistance, in which a steel material having tempered martensite structure is used to form the bolt in order to improve the delayed fracture resistance of the bolt by avoiding temper brittleness, decreasing of intergranular segregation elements, decreasing grain size and the like. The inventors had further studied and consequently found that the delayed fracture resistance can be further improved by 1) preparing a steel material having a predetermined pearlite structure and 2) working (wire drawing) of the steel material at a relatively high drawing rate to form a wire having a relatively high reduction rate of the cross sectional area (hereinafter, referred to as "severe working" or "severe drawing"), to give a strength of 1200 N/mm$^2$ or more to the resultant bolt.

According to the present invention, it is necessary to draw severely a steel material that has pro-eutectoid ferrite, pro-eutectoid cementite, bainite and martensite structures, whose total area is less than 20% with respect to the entire cross sectional area of wire rod of the steel material, and pearlite structure as the balance (i.e., the pearlite area rate is beyond 80%). The reasons of these limitations on the steel material structure are as follows.

Of the aforementioned structures, when the steel material has excessive rates of pro-eutectoid ferrite and pro-eutectoid cementite structures, it is difficult to draw the steel material due to the sliver generation along the drawing direction. Thus, such a severe drawing process cannot be completed and thereby it fails to give the resultant bolt a strength of 1200 N/mm$^2$ or more. In addition, the steel material needs to have a small amount of pro-eutectoid cementite and martensite structures so as to suppress the wire-breaking of the rod wire of the steel material during the drawing. Moreover, it needs to include a sufficiently small amount of the bainite structure. This is because, compared with pearlite, the bainite structure is less hardened by working (drawing) and so it cannot lead an increased steel strength due to the severe drawing.

On the contrary, the amount of the pearlite structure needs to be as large as possible. This is because the pearlite structure contributes to the decrease of hydrogen atom accumulation on grain boundaries by trapping such hydrogen atoms on the interfaces between cementite and ferrite within each grain thereof. Accordingly, by decreasing at least one amount of structures of pro-eutectoid ferrite, pro-eutectoid cementite, bainite and martensite and the like to lessen the total area rate of these structures to below 20% and thus raise the area rate of pearlite structure to beyond 80%, the obtained steel material can exhibit an excellent strength and delayed fracture resistance. The area rate of the pearlite structure is preferably 90% or more, and more preferably 100%.

The rolled or forged steel material itself (i.e., without drawing the steel material) cannot have a sufficiently high dimension accuracy for forming into a bolt shape. In addition, if such a steel material is used for producing the high-strength bolt, the obtained bolt cannot have a strength of 1200 N/mm$^2$ or more. For the reasons, it is necessary to subject the rolled or forged steel material to the drawing process in the present invention. In addition, this drawing can disperse a part of the cementite regions in the pearlite structure into its smaller regions, to improve the ability of trapping hydrogen atoms. Moreover, due to the drawing, the grains of the structure are flattened along the drawing direction so as to resist to crack propagation. This means as follows. If the wire rod has not been drawn, a crack propagates along the grain boundaries (the interfaces between grains) in a direction approximately perpendicular to the drawing direction, whereas, in the drawn wire rod, such flatten grains block the grain boundaries of the crack propagating direction to disturb the crack propagation.

On the other hand, the inventors have also studied from the point of view of improving a relaxation property of the obtained bolt. As a result, it was proved that a blueing at a predetermined temperature, which follows the severe drawing of the above-mentioned steel material and the cold heading for forming the drawn steel material into a predetermined bolt shape, can increase the bolt strength. It can result in extremely improving the relaxation property of the obtained bolt. In other words, the blueing can lead an age hardening of C and N so as to prevent the plastic deformation of the resultant bolt. This can lead effects of improving the bolt strength and proof stress ratio of the obtained bolt and, in addition, suppressing the thermal fatigue of the bolt at 100 to 200° C. In order to exhibit these effects, the blueing temperature needs to be within a range of 100 to 400° C. In case of the temperature less than 100° C., the age hardening is not satisfactorily large. So the increases of bolt strength and proof stress ratio are too small, resulting that the relaxation property of the bolt cannot be satisfactorily improved. On the contrary, in case of the blueing temperature more than 400° C., the bolt-shaped steel material is likely to be softened to drop the bolt strength severely.

In addition, in order to obtain the above-mentioned effects, the blueing is desirably performed with keeping a temperature within the above-mentioned range for about 30 minutes to 4 hours. In the present invention, the cold heading (forging) is performed for forming the drawn steel material into the predetermined bolt shape. The reasons are as follows: the cold heading needs less manufacturing costs than warm or hot heading (forging); and, by hot and warm heading, the drawn steel material is likely to be softened by heat and thereby the drawn pearlite structure may be disordered so as not to obtain a predetermined strength.

The steel material for the high-strength bolt according to the present invention is a medium or high steel having 0.50 to 1.0% of C. In addition, as the basic chemical composition, the steel material includes both 0.5% or less (not including 0%) of Si and 0.2 to 1% of Mn. It also includes limited amounts of P to 0.03% or less (including 0%) and S to 0.03% or less. The reasons of these limitations on the contents are respectively explained in the followings. It should be noted that, hereinafter, both a wire or rod obtained by hot working the steel material and that obtained by hot working and then heat treating the steel material are referred to as "wire rod", and a wire or rod obtained by the cold working (including drawing) of the wire rod is referred to as "steel wire", in order for the distinction of these two.

C: 0.5 to 1.0%

C is an effective and economical element for increasing the bolt strength. As the C content of the steel material increases, the strength of the resultant bolt increases. To obtain the bolt having a target strength, the steel material for the bolt needs to contain 0.50% or more of C. However, when the C content is beyond 1.0%, a precipitation amount of pro-eutectoid cementite is likely to increase. This results in extremely lowering steel toughness and ductility, thereby deteriorating steel drawability. Therefore, the upper limit of the C content is 1.0%. The lower limit of the C content is preferably 0.65%, and more preferably 0.7%. Also, the upper limit of the C content is preferably 0.9%, and more preferably 0.85%. An eutectoid steel is most desirably used.

Si: 0.5% or less (0% is not included)

Si exhibits an effect of suppressing precipitation of pro-eutectoid cementite by improving the hardenability of the steel material. Si can be also expected to act as a deoxidizing agent. Moreover, Si can make a solid solution with ferrite, to exhibit an excellent solid-solution strengthening. These effects of Si are more improved, as the Si content of the steel material increases. However, the excessive Si content is likely to lower the ductility as well as the cold headability of the steel wire. From the point of view, the upper limit of the Si content is 0.5%, preferably 0.1%, and more preferably 0.05%.

Mn: 0.2 to 1.0%

Mn can act as a deoxidizing agent and also, by increasing the hardenability of the wire rod, improve the cross sectional structure uniformity of the resultant wire rod. These effects of Mn can be effectively caused when the Mn content is 0.2% or more. However, the Mn content is too large, the low temperature transformed structures such as martensite and bainite are likely to generate in Mn segregation section, resulting in deterioration of drawability of the steel material. The upper limit of the Mn content is therefore 1.0%. The Mn content is preferably about 0.40 to 0.70%, and more preferably about 0.45 to 0.55%.

P: 0.03% or less (including 0%)

P is an element that is likely to segregate on grain boundaries, to deteriorate the delayed fracture resistance of the resultant bolt. Therefore, by suppressing the P content to 0.03% or less, the delayed fracture resistance can be improved. The P content is preferably 0.015% or less, more preferably 0.01% or less and further preferably 0.005% or less.

S: 0.03% or less (including 0%)

S reacts with Mn to from a MnS portion in the steel material. The MnS portion is likely to become a stress concentration portion when the stress is imposed. Accordingly, it is necessary to lower the S content for improving the delayed fracture resistance of the resultant bolt. From this point of view, the S content is favorably suppressed to 0.03% or less. The S content is preferably 0.015% or less, more preferably 0.01% or less and further preferably 0.005% or less.

In a method according to the present invention, the steel material to be used as the raw material for the high-strength bolt basically has the above-mentioned chemical composition. If necessary, the steel material effectively has additive elements such as (a) 0.5% or less (not including 0%) of Cr and/or 0.5% or less (not including 0%) of Co and (b) 0.3% or less (not including 0%) of the total content of one or more selected from a group consisting of Mo, V and Nb. The reasons of the limitations on the contents of respective these elements, which can be added as needed, are as follows.

Cr: 0.5% or less (not including 0%) and/or Co: 0.50% or less (not including 0%)

As in case with Si, both Cr and Co have an effect of suppressing precipitation of pro-eutectoid cementite. Thus, they are particularly effective to add to the steel material for the high-strength bolt according to the present invention, because, in the present invention, the bolt strength is intended to be improved by the decrease of pro-eutectoid cementite. As the contents of Cr and/or Co increase, this effect becomes greater. However, when the contents reach beyond 0.5%, the effect cannot be improved any further. In addition, such large contents of these elements cost expensive. The upper limit of the contents is therefore 0.5%. The Cr and/or Co contents are preferably within a range of 0.05 to 0.3%, and more preferably 0.1 to 0.2%.

One or more selected from a group consisting of Mo, V and Nb: 0.3% or less (not including 0%) in total Mo, V and Nb can respectively produce fine nitride and carbide that contribute to the improvement of the delayed fracture resistance of the bolt. In addition, these nitride and carbide can also effective to make the steel material grains finer. The excess contents of these elements, however, are likely to result in deteriorated delayed fracture resistance and toughness of the bolt. Thus, the total content of these elements was decided to be 0.3% or less. The total content of Mo, V and Nb is preferably within a range of 0.02 to 0.2%, and more preferably 0.05 to 0.1%.

The steel material used in the present invention has the above-mentioned chemical composition. The balance substantially consists of Fe. The phrase "substantially consists of Fe" means that the high-strength bolt according to the present invention can include minor constituents (allowable compositions) besides Fe to such an extent that cannot deteriorate the bolt properties. The allowable compositions includes elements such as Cu, Ni, Al, Ca, B, Zr, Pb, Bi, Te, As, Sn, Sb and N and inevitable impurities such as O.

According to the present invention, it is possible to adjust the structure of the wire rod for the bolt through various methods. Of these, two typical methods, (i) and (ii), are described in the followings. In one of the typical methods (method (i)), the wire rod is produced by 1) using the steel material having the above-mentioned chemical composition, 2) hot rolling or hot forging the steel material in such a manner that the termination temperature of the hot rolling or forging is 800° C. or more and 3) cooling the hot rolled or forged steel material continuously until the steel material temperature reaches 400° C. , with average cooling rate V (° C./second) satisfying the following equation (1), followed by cooling it in the air.

$$166\times(\text{wire diameter: mm})^{-1.4} \leqq V \leqq 288\times(\text{wire diameter: mm})^{-1.4} \quad (1)$$

The wire rod obtained by method (i) can have more uniform pearlite structure than ordinary rolled steels, thereby improving the strength of the wire rod before subjected to the drawing process. In case that the termination temperature of the hot rolling or forging is too low, the austenitizing is not satisfactorily progressed and thereby the uniform pearlite structure cannot be obtained. This is the reason why the termination temperature needs to be 800° C. or more. This temperature is preferably with in a range of 850 to 950° C., and more preferably 850 to 900° C.

In case that the average cooling rate V is less than $166\times(\text{wire diameter: mm})^{-1.4}$, not only may the wire rod fail to have the uniform pearlite structure but also pro-eutectoid ferrite and pro-eutectoid cementite are easily produced therein. On the contrary, in case that the average cooling rate V is greater than $288\times(\text{wire diameter: mm})^{-1.4}$, bainite and martensite are easily produced.

Alternatively, the wire rod according to the present invention can be produced by 1) using the steel material having the above-mentioned chemical composition, 2) heating the steel material up to 800° C. or higher and 3) rapid cooling the heated steel material to 500 to 650° C. and then, with the temperature kept constantly, leaving it in an isothermal state (patenting treatment) (method (ii)). This method can result in a more uniform pearlite structure than ordinary rolled steels. This improves the wire rod strength before the drawing process.

In method (ii), the heating temperature of the steel material needs to be 800° C. or higher because of the same reason for the rolling and forging temperature in method (i). In the patenting treatment process, the heated wire rod is preferably cooled rapidly at as a high cooling rate as possible by using a salt bath, lead, fluidized bed or the like. Then, in order to obtain the uniform pearlite structure, the rapidly cooled wire rod needs to be subjected to an isothermal transformation at a constant temperature within a range of about 500 to 650° C. The preferable range of the constant temperature for the isothermal transformation is about 550 to 600° C. The most preferable constant temperature, at which the wire rod is left for the isothermal transformation, is a temperature around the pearlite nose of T. T. T. diagram (Time-Temperature-Transformation curve).

EXAMPLES

The following examples are being supplied to further define the present invention, it being noted that these examples are intended to illustrate and not limit the scope of the present invention.

Example 1

Sample steels A to O having respective chemical compositions shown in Table 1 were used in this example. Each of the sample steels was hot rolled in such a manner that the termination temperature of rolling is about 930° C., to form a wire rod having a wire diameter of 8 to 14 mmϕ. Then the wire rod was cooled with air blast in such a manner that the average cooling rate is within a range of 4.2 to 12.4° C./sec (Table 2). Subsequently, the cooled wire rod was drawn until the wire diameter reached 7.06 mmϕ or 5.25 mmϕ (the drawing rate: 57 to 75%), to obtain a steel wire.

TABLE 1

| Sample | Chemical composition (mass %) | | | | | | | | |
|---|---|---|---|---|---|---|---|---|---|
| Steel | C | Si | Mn | P | S | Al | N | O | Others |
| A | 0.46 | 0.20 | 0.54 | 0.005 | 0.003 | 0.029 | 0.004 | 0.0007 | |
| B | 0.59 | 0.19 | 0.53 | 0.006 | 0.004 | 0.030 | 0.005 | 0.0007 | |
| C | 0.85 | 0.27 | 0.76 | 0.014 | 0.011 | 0.052 | 0.005 | 0.0006 | |
| D | 0.98 | 0.21 | 0.54 | 0.006 | 0.004 | 0.032 | 0.005 | 0.0006 | |
| E | 1.09 | 0.20 | 0.53 | 0.005 | 0.003 | 0.003 | 0.005 | 0.0007 | |
| F | 0.83 | 0.89 | 0.75 | 0.015 | 0.004 | 0.036 | 0.006 | 0.0006 | |
| G | 0.82 | 0.20 | 0.12 | 0.005 | 0.004 | 0.030 | 0.006 | 0.0024 | |
| H | 0.80 | 0.21 | 1.19 | 0.005 | 0.003 | 0.031 | 0.005 | 0.0005 | |
| I | 0.82 | 0.25 | 0.74 | 0.010 | 0.006 | 0.026 | 0.004 | 0.0007 | Cr: 0.17 |
| J | 0.94 | 0.21 | 0.49 | 0.007 | 0.003 | 0.031 | 0.006 | 0.0006 | Cr: 0.32 |
| K | 0.95 | 0.20 | 0.75 | 0.005 | 0.003 | 0.030 | 0.009 | 0.0007 | Co: 0.49 |
| L | 0.84 | 0.19 | 0.75 | 0.005 | 0.004 | 0.029 | 0.004 | 0.0007 | Mo: 0.22 |
| M | 0.83 | 0.20 | 0.75 | 0.005 | 0.003 | 0.028 | 0.004 | 0.0006 | V: 0.21 |
| N | 0.82 | 0.20 | 0.74 | 0.006 | 0.004 | 0.030 | 0.007 | 0.0007 | Nb: 0.05 |
| O | 0.34 | 0.19 | 0.70 | 0.016 | 0.009 | 0.033 | 0.003 | 0.0009 | Cr: 0.95, Mo: 0.18 |

Figure 1B:
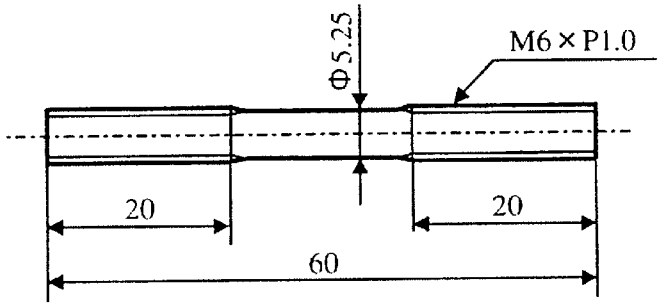

From each of the obtained steel wires, produced was a stud bolt either M8×P1.25 (FIG. 1(*a*), produced from the steel wire having a wire diameter of 7.06 mmϕ) or M6×P1.0 (FIG. 1(*b*), produced from the steel wire having a wire diameter of 5.25 mmϕ) shown in FIG. 1. The stud bolt was subjected to a delayed fracture resistance test. The delayed fracture resistance test was performed by: 1) dipping the bolt into an acid (15% HCl) for 30 minutes; 2) washing it with water and dried; 3) applying a stress to the bolt in the air (the applied stress equaled to 90% of the tensile strength) for 100 hours; and 4) evaluating the delayed fracture resistance of the bolt by checking whether the bolt had a fracture or not. In addition, pro-eutectoid ferrite, pro-eutectoid cementite, bainite, martensite and pearlite structure portions in the cross section of the steel wire were respectively identified through the following method, followed by the calculation of the respective area rates of these structure portions. For the comparison, sample steel O was quenched and tempered to give a tempered martensite as shown in Table 2. A stud bolt, which serves as a comparative example, was produced from the quenched and tempered steel and then subjected to the same delayed fracture resistance test as the other sample steels.

(Identification of Structures)

Figure 2:
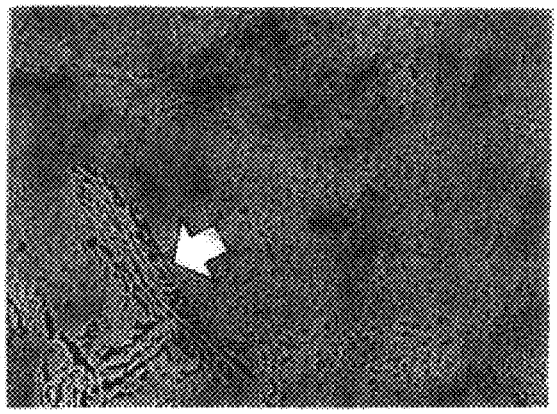
FIG. 2 is a photomicrograph showing a bainite structure.
Figure 3:
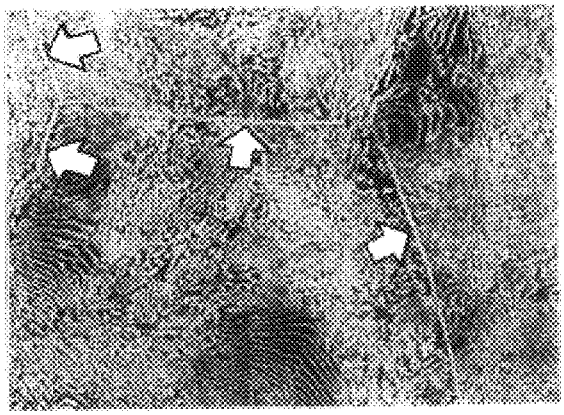
FIG. 3 is a photomicrograph showing a pro-eutectoid cementite structure.
Figure 4:
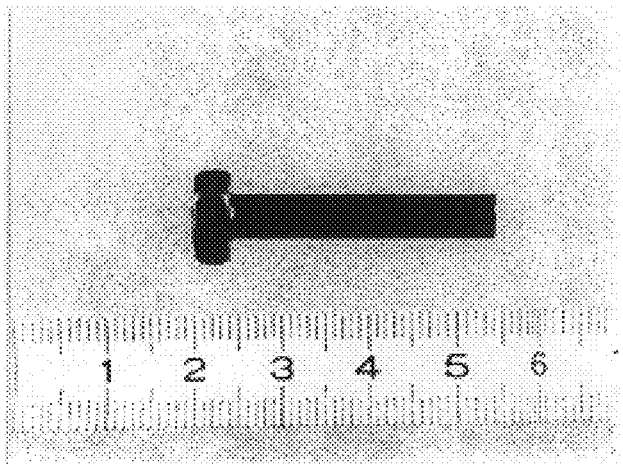
FIG. 4 is a photograph showing a hexagon head bolt of example 2.
Figure 5:
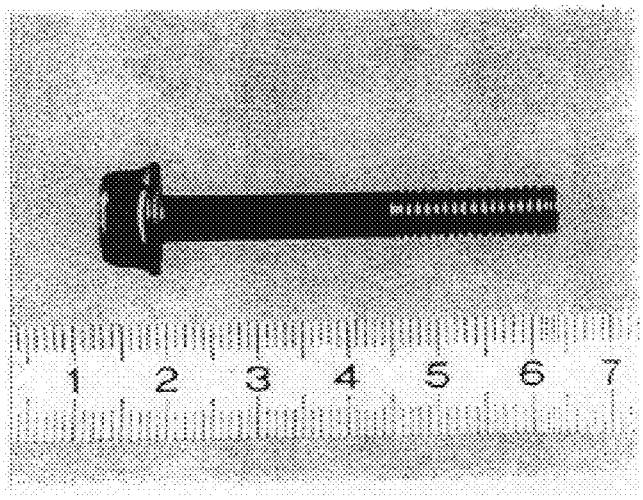
FIG. 5 is a photograph showing a hexagon flange bolt of example 2.

In each example, the cross sections of the wire rod and steel wire were respectively embedded. Each surface of the cross sections was polished, and then dipped into an alcohol liquid of 5% picric acid for 15 to 30 seconds, to corrode the cross section surface. Subsequently, it is carried out to observe the structure in a doughnut region within a distance of D/4 (D: diameter) from the edge of each wire rod or steel wire cross sectional surface by scanning electron microscope (SEM). By photographing 5 to 10 fields of view magnified 1000 to 3000 times, pearlite structure portions were identified. After that, the respective area rates of the above-mentioned steel structures were obtained with an image analysis apparatus. As to the bainite and pro-eutectoid cementite structures that are difficult to be distinguished from the pearlite structure, such a structure as shown in FIG. 2 (a microphotograph of the steel structure) was decided as the bainite structure and that as shown in FIG. 3 (a microphotograph of the steel structure) was decided as the pro-eutectoid cementite structure. The structures of pro-eutectoid ferrite and pro-eutectoid cementite were tend to precipitate along the grain boundaries of the original austenite. Martensite was tend to precipitate in clusters.

In addition, by using the respective above-mentioned steel wires, hexagon head bolts and hexagon flange bolts were produced by cold heading. The heads of the produced bolts were observed to check whether a crack had been generated or not during the cold heading process.

Table 2 shows structures of the respective wire rods and steel wires together with the average cooling rates. Table 3 shows the results of the delayed fracture resistance test and whether the bolt heads had a crack or not together with the drawing conditions and mechanical properties. In the delayed fracture resistance tests, 10 bolts made from each one sample steel were subjected to the test. When none of the 10 bolts made from a same sample steel was fractured, the bolts were determined to have a good delayed fracture resistance (represented as the symbol "○"). On the contrary, when at least one of the ten bolts of a sample steel was fractured, the bolts were regarded to have an unsatisfactory delayed fracture resistance (represented as the symbol "X").

These results reveal that, according to the present invention, the steel wire can be cold headed without any crack generation, to obtain the high-strength bolt. It is also clear that a hexagon head bolt and hexagon flange bolt excellent in delayed fracture resistance can be obtained.

TABLE 2

| Sample Steel | Test No. | Initial diameter (mm) | Average cooling rate (° C./sec) | pro-eutectoid ferrite area rate (%) | Pro-eutectoid cementite area rate (%) | Bainite area rate (%) | Martensite area rate (%) | Pearlite area rate (%) | Note ** |
|---|---|---|---|---|---|---|---|---|---|
| A | 1 | 14.0 | 5.5 | 35 | 0 | 0 | 0 | 65 | Comp. ex |
| B | 2 | 14.0 | 6.1 | 15 | 0 | 0 | 0 | 85 | Ex |
| C | 3 | 14.0 | 6.2 | 15 | 0 | 0 | 0 | 85 | Ex |
| C | 4 | 11.0 | 8.8 | 10 | 0 | 0 | 0 | 90 | Ex |
| C | 5 | 8.0 | 12.5 | 10 | 0 | 0 | 0 | 90 | Ex |
| D | 6 | 11.0 | 8.5 | 0 | 10 | 0 | 0 | 90 | Ex |

TABLE 2-continued

| Sample Steel | Test No. | Initial diameter (mm) | Average cooling rate (° C./sec) | pro-eutectoid ferrite area rate (%) | Pro-eutectoid cementite area rate (%) | Bainite area rate (%) | Martensite area rate (%) | Pearlite area rate (%) | Note ** |
|---|---|---|---|---|---|---|---|---|---|
| E | 7 | 11.0 | 8.6 | 0 | 35 | 0 | 0 | 65 | Comp. ex |
| F | 8 | 8.0 | 10.5 | 10 | 0 | 0 | 0 | 90 | Comp. ex |
| G | 9 | 11.0 | 8.5 | 10 | 0 | 0 | 0 | 90 | Comp. ex |
| H | 10 | 11.0 | 8.6 | 0 | 0 | 10 | 25 | 65 | Comp. ex |
| I | 11 | 10.5 | 8.5 | 10 | 0 | 0 | 0 | 90 | Ex |
| I | 12 | 8.0 | 10.5 | 10 | 0 | 0 | 0 | 90 | Ex |
| J | 13 | 11.0 | 8.6 | 0 | 5 | 0 | 0 | 95 | Ex |
| K | 14 | 11.0 | 8.5 | 0 | 5 | 0 | 0 | 95 | Ex |
| L | 15 | 11.0 | 8.6 | 5 | 0 | 0 | 0 | 95 | Ex |
| M | 16 | 11.0 | 8.5 | 5 | 0 | 0 | 0 | 95 | Ex |
| N | 17 | 11.0 | 8.5 | 10 | 0 | 0 | 0 | 90 | Ex |
| O | 18 | 11.0 | 880° C. × 30 min. → OQ, 460° C. × 90 min. → WC 100% tempered martensite structure | | | | | — | Comp. ex |

**: a note whether it is an example according to the present invention or a comparative example

TABLE 3

| Test No. | Initial Wire Diameter (mm) | Initial strength (N/mm$^2$) | Terminal wire diameter (mm) | Terminal strength (N/mm$^2$) | Drawing ratio (%) | Draw-ability | Delayed fractur-ability | Cold heading of bolt head: Hexagon headed | Cold heading of bolt head: Hexagon flange | Note ** |
|---|---|---|---|---|---|---|---|---|---|---|
| 1 | 14.0 | 688 | 7.06 | 1124 | 75 | Insuf. Strength | — | — | — | Comp. ex |
| 2 | 14.0 | 821 | 7.06 | 1245 | 75 | Excellent | ○ | No crack | No crack | Ex |
| 3 | 14.0 | 1072 | 7.06 | 1654 | 75 | Excellent | ○ | No crack | No crack | Ex |
| 4 | 11.0 | 1153 | 7.06 | 1533 | 59 | Excellent | ○ | No crack | No crack | Ex |
| 5 | 8.0 | 1261 | 5.25 | 1375 | 57 | Excellent | ○ | No crack | No crack | Ex |
| 6 | 11.0 | 1227 | 7.06 | 1663 | 59 | Excellent | ○ | No crack | No crack | Ex |
| 7 | 11.0 | 1685 | 7.06 | * | | Breaking | — | — | — | Comp. ex |
| 8 | 8.0 | 1343 | 5.25 | 1687 | 57 | Excellent | ○ | Cracked | Cracked | Comp. ex |
| 9 | 11.0 | 1052 | 7.06 | * | | Breaking | — | — | — | Comp. ex |
| 10 | 11.0 | 1387 | 7.06 | * | | Breaking | — | — | — | Comp. ex |
| 11 | 10.5 | 1153 | 5.25 | 1694 | 75 | Excellent | ○ | No crack | No crack | Ex |
| 12 | 8.0 | 1201 | 5.25 | 1550 | 57 | Excellent | ○ | No crack | No crack | Ex |
| 13 | 11.0 | 1255 | 7.06 | 1674 | 59 | Excellent | ○ | No crack | No crack | Ex |
| 14 | 11.0 | 1230 | 7.06 | 1653 | 59 | Excellent | ○ | No crack | No crack | Ex |
| 15 | 11.0 | 1152 | 7.06 | 1527 | 59 | Excellent | ○ | No crack | No crack | Ex |
| 16 | 11.0 | 1148 | 7.06 | 1519 | 59 | Excellent | ○ | No crack | No crack | Ex |
| 17 | 11.0 | 1145 | 7.06 | 1512 | 59 | Excellent | ○ | No crack | No crack | Ex |
| 18 | 11.0 | — | 7.06 | 1318 | — | — | x | — | — | Comp. ex. |

*: The drawing could not be completed due to the breaking of the wires.
**: a note whether it is an example according to the present invention or a comparative example

Example 2

Sample steels C and I shown in Table 1 were used in this example. Each of the sample steels was hot rolled to form a wire rod having a wire diameter of 8 or 10.5 mmϕ, followed by the patenting treatment. In the patenting treatment, the sample steel was heated to a temperature of 940° C. and then kept it at a constant temperature within a rage of 510 to 610° C. for 4 minutes for the isothermal transformation. Subsequently, the obtained steel material (wire rod) was drawn until the wire diameter reached 7.06 or 5.25 mmϕ (the drawing rate: 57 to 75%) to obtain a steel wire.

From each of the obtained steel wires, produced was a stud bolt either M8×P1.25 (produced from the steel wire having a wire diameter of 7.06 mmϕ) or M6×P1.0 (produced from the steel wire having a wire diameter of 5.25 mmϕ). The stud bolt was subjected to the delayed fracture resistance test in the same manner in example 1.

In addition, by using the respective above-mentioned steel wires, hexagon head bolts and hexagon flange bolts were produced by cold heading. The heads of the produced bolts were observed to check whether a crack had been generated or not during the cold heading process.

Table 4 shows structures of the respective wire rods and steel wires together with the average cooling rates. Table 5 shows the results of the delayed fracture resistance test and whether the bolt heads had a crack or not together with the drawing conditions and mechanical properties.

These results reveal that, according to the present invention, the steel wire can be cold headed without any crack generation, to obtain the high-strength bolt. It is also clear that a hexagon head bolt and hexagon flange bolt excellent in delayed fracture resistance can be obtained.

TABLE 4

| Sample steel | test No. | Initial wire Diameter (mm) | Constant temp. (° C.) | Pro-eutectoid ferrite area rate (%) | Pro-eutectoid cementite area rate (%) | Bainite area rate (%) | Martensite area rate (%) | Pearlite area rate (%) | Note ** |
|---|---|---|---|---|---|---|---|---|---|
| C | 19 | 8.0 | 510 | 5 | 0 | 0 | 0 | 95 | Ex |
| I | 20 | 10.5 | 610 | 5 | 0 | 0 | 0 | 95 | Ex |
| I | 21 | 10.5 | 610 | 5 | 0 | 0 | 0 | 95 | Ex |
| I | 22 | 8.0 | 525 | 5 | 0 | 0 | 0 | 95 | Ex |

**: a note whether it is an example according to the present invention or a comparative example

TABLE 5

| Test No. | Initial Wire Diameter (mm) | Initial strength (N/mm$^2$) | Terminal wire diameter (mm) | Terminal strength (N/mm$^2$) | Drawing ratio (%) | Draw-ability | Delayed fractur-ability | Cold heading of bolt head: Hexagon headed | Cold heading of bolt head: Hexagon flange | Note ** |
|---|---|---|---|---|---|---|---|---|---|---|
| 19 | 8.0 | 1275 | 5.25 | 1645 | 57 | Excellent | ○ | No crack | No crack | Ex |
| 20 | 10.5 | 1145 | 7.06 | 1546 | 55 | Excellent | ○ | No crack | No crack | Ex |
| 21 | 10.5 | 1145 | 5.25 | 1696 | 75 | Excellent | ○ | No crack | No crack | Ex |
| 22 | 8.0 | 1292 | 5.25 | 1622 | 57 | Excellent | ○ | No crack | No crack | Ex |

**: a note whether it is an example according to the present invention or a comparative example

Example 3

Steel wires of tests Nos. 11, 12, 19 and 22 shown in Tables 3 and 5 (wire diameter: 5.25 mmϕ produced by drawing) were subjected to a relaxation test. The relaxation test was performed according to JIS G3538 of hard drawn steel wires for prestressed concrete. The test temperature was not a normal temperature but a high temperature of 130° C. in order to compare the stress relaxation resistance properties of the steel wires at the high temperature.

It was carried out to measure a load which causes 0.2% permanent elongation (poof stress) of each of the above-mentioned steel wires being applied with no treatment or with blueing. Thereafter, each steel wire was gripped at properly spaced positions, and was initially applied with a load equal to 80% of the load causing the 0.2% elongation. The steel wire was held in the gripping space for 10 hours, and measurement was performed about a load which the steel wire was subjected to. A stress after such 10-hour relaxation test was determined as relaxation stress.

The results are shown in table 6 together with the respective processes, mechanical properties and test conditions (initial loads). These results proved that the blued steel wires have an increased tensile strength and 0.2% poof stress, as well as keeping a high relaxation stress.

TABLE 6

| test No. | Process | Tensile strength (N/mm$^2$) | 0.2% proof stress (N/mm$^2$) | Loading (N/mm$^2$) | Relaxation stress (N/mm$^2$) | Note ** |
|---|---|---|---|---|---|---|
| 11 | drawing only | 1694 | 1264 | 1011 | 911 | Comp. ex |
| 11A | drawing → 200° C. blueing | 1798 | 1761 | 1409 | 1195 | Ex. |
| 11B | drawing → 300° C. blueing | 1782 | 1631 | 1305 | 1165 | Ex. |
| 12 | drawing only | 1550 | 1201 | 961 | 866 | Comp. ex |
| 12A | drawing → 200° C. blueing | 1673 | 1642 | 1314 | 1156 | Ex. |
| 12B | drawing → 300° C. blueing | 1664 | 1618 | 1294 | 1164 | Ex. |
| 19 | drawing only | 1645 | 1250 | 1000 | 901 | Comp. ex |
| 19A | drawing → 200° C. blueing | 1770 | 1681 | 1345 | 1177 | Ex. |
| 19B | drawing → 300° C. blueing | 1760 | 1671 | 1337 | 1196 | Ex. |
| 22 | drawing only | 1622 | 1246 | 997 | 898 | Comp. ex |
| 22A | drawing → 200° C. blueing | 1738 | 1656 | 1325 | 1159 | Ex. |
| 22B | drawing → 300° C. blueing | 1726 | 1547 | 1238 | 1105 | Ex. |

**: a note whether it is an example according to the present invention or a comparative example

Industrial Applicability

As described above, provided can be a high-strength bolt having excellent delayed fracture and stress relaxation resistances in addition to a high tensile strength of 1200 N/mm$^2$.

What is claimed is:

1. A method for producing a high-strength bolt having excellent delayed fracture resistance and stress relaxation resistance, comprising:

preparing a steel material comprising 0.50 to 1.0% by mass of C, 0.5% by mass or less of Si, not including 0% by mass, 0.2 to 1% by mass of Mn, 0.03% by mass or less of P, including 0% by mass; and 0.03% by mass or less of S, including 0% by mass;

said steel material comprising a total of less than 20% by mass of a pro-eutectoid ferrite structure, a pro-eutectoid cementite structure, a bainite structure and a martensite structure; and a remainder of a pearlite structure;

drawing said steel material severely to obtain a steel wire;

forming said steel wire into a bolt shape through a cold heading, to obtain a shaped steel wire; and subjecting said shaped steel wire to a blueing treatment at a temperature within a range of 100 to 400° C.; thereby producing a high-strength bolt having excellent delayed fracture resistance and stress relaxation resistance in addition to a tensile strength of 1200 N/mm$^2$ or higher.

2. The method for producing a high-strength bolt according to claim 1, wherein said steel material further comprises 0.5% by mass or less of Cr, not including 0% by mass;

0.5% by mass or less of Co, not including 0% by mass; or a mixture of 0.5% by mass or less of Cr, not including 0% by mass and 0.5% by mass or less of Co, not including 0% by mass.

3. The method for producing a high-strength bolt according to claim 1 or 2, wherein said steel material further comprises a total content of 0.3% by mass or less, not including 0% of one or more members selected from the group consisting of Mo, V and Nb.

4. The method according to claim 1, wherein said remainder of said perlite structure is at least 90% by mass.

5. The method according to claim 1, wherein a time for said blueing treatment is about 30 minutes to 4 hours.

6. The method according to claim 1, wherein said steel material comprises 0.65 to 0.9% by mass of C.

7. The method according to claim 1, wherein said steel material comprises 0.1% by mass or less of Si, not including 0% by mass.

8. The method according to claim 1, wherein said steel material comprises 0.40 to 0.70% by mass of Mn.

9. The method according to claim 1, wherein said steel material comprises 0.015% by mass or less of P.

10. The method according to claim 1, wherein said steel material comprises 0.015% by mass or less of S.

* * * * *